US012173474B2

(12) United States Patent
Okuyama et al.

(10) Patent No.: US 12,173,474 B2
(45) Date of Patent: Dec. 24, 2024

(54) WORK MACHINE

(71) Applicant: SUMITOMO CONSTRUCTION MACHINERY CO., LTD., Tokyo (JP)

(72) Inventors: Minoru Okuyama, Chiba (JP); Ryou Matsuki, Chiba (JP); Masaki Makino, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 740 days.

(21) Appl. No.: 17/210,770

(22) Filed: Mar. 24, 2021

(65) Prior Publication Data

US 2021/0301498 A1 Sep. 30, 2021

(30) Foreign Application Priority Data

Mar. 26, 2020 (JP) ..... 2020-056734

(51) Int. Cl.

| | |
|---|---|
| ***E02F 9/20*** | (2006.01) |
| ***E02F 9/16*** | (2006.01) |
| ***E02F 9/22*** | (2006.01) |
| ***E02F 9/26*** | (2006.01) |

(52) U.S. Cl.

CPC ..... *E02F 9/2033* (2013.01); *E02F 9/166* (2013.01); *E02F 9/2235* (2013.01); *E02F 9/26* (2013.01)

(58) Field of Classification Search

CPC ... E02F 9/26; E02F 9/261; E02F 9/166; E02F 9/2022; E02F 9/2033; E02F 9/2235; E02F 9/2246; E02F 9/2253; E02F 9/2292; E02F 9/2296; E02F 9/2232; E02F 9/2285

See application file for complete search history.

(56) References Cited

U.S. PATENT DOCUMENTS

| | | | | |
|---|---|---|---|---|
| 3,957,165 | A * | 5/1976 | Smith | B66C 13/54 180/327 |
| 5,865,264 | A * | 2/1999 | Glass | B66C 13/54 180/89.15 |
| 5,890,557 | A * | 4/1999 | Glass | B62D 33/063 180/89.15 |
| 6,269,913 | B1 * | 8/2001 | Kollmannsberger | B66F 9/06 187/394 |
| 10,807,847 | B2 * | 10/2020 | Ourada | B66F 9/22 |
| 11,077,896 | B1 * | 8/2021 | Ourada | B62D 55/0655 |
| 2004/0256343 | A1 * | 12/2004 | Maruyama | B66C 13/54 212/291 |

FOREIGN PATENT DOCUMENTS

| | | |
|---|---|---|
| EP | 1447371 | 8/2004 |
| EP | 3438351 | 2/2019 |
| EP | 3553234 | 10/2019 |
| JP | 2004-132077 | 4/2004 |
| JP | 2004-346983 | 12/2004 |
| JP | 2013-28926 | 2/2013 |
| JP | 2016-176288 | 10/2016 |

OTHER PUBLICATIONS

JP2013028926A Feb. 7, 2013 Google machine translation.*

* cited by examiner

*Primary Examiner* — Sizo B Vilakazi
(74) *Attorney, Agent, or Firm* — IPUSA, PLLC

(57) ABSTRACT

A work machine includes an elevating cab and processing circuitry. The processing circuitry is configured to detect the position of the elevating cab and to maintain a travel speed at low speed when a traveling operation is performed while the detected position of the elevating cab is higher than a predetermined height.

12 Claims, 7 Drawing Sheets

WORK MACHINE

CROSS-REFERENCE TO RELATED APPLICATIONS

This application is based upon and claims priority to Japanese patent application No. 2020-056734, filed on Mar. 26, 2020, the entire contents of which are hereby incorporated herein by reference.

BACKGROUND

Technical Field

The present invention relates to work machines.

Description of Related Art

A work machine equipped with an elevating cab configured to rise and lower has been known.

SUMMARY

According to an aspect of the present invention, a work machine includes an elevating cab and processing circuitry. The processing circuitry is configured to detect the position of the elevating cab and to maintain a travel speed at low speed when a traveling operation is performed while the detected position of the elevating cab is higher than a predetermined height.

DETAILED DESCRIPTION

According to the above-described related-art work machine, shaking during traveling may affect the fatigue life of a structure that moves up and down the elevating cab (operator cabin), etc. According to the above-described related-art work machine, however, no consideration is given to shaking during traveling.

According to an aspect of the present invention, it is possible to reduce the effect of shaking during traveling.

Figure 1:
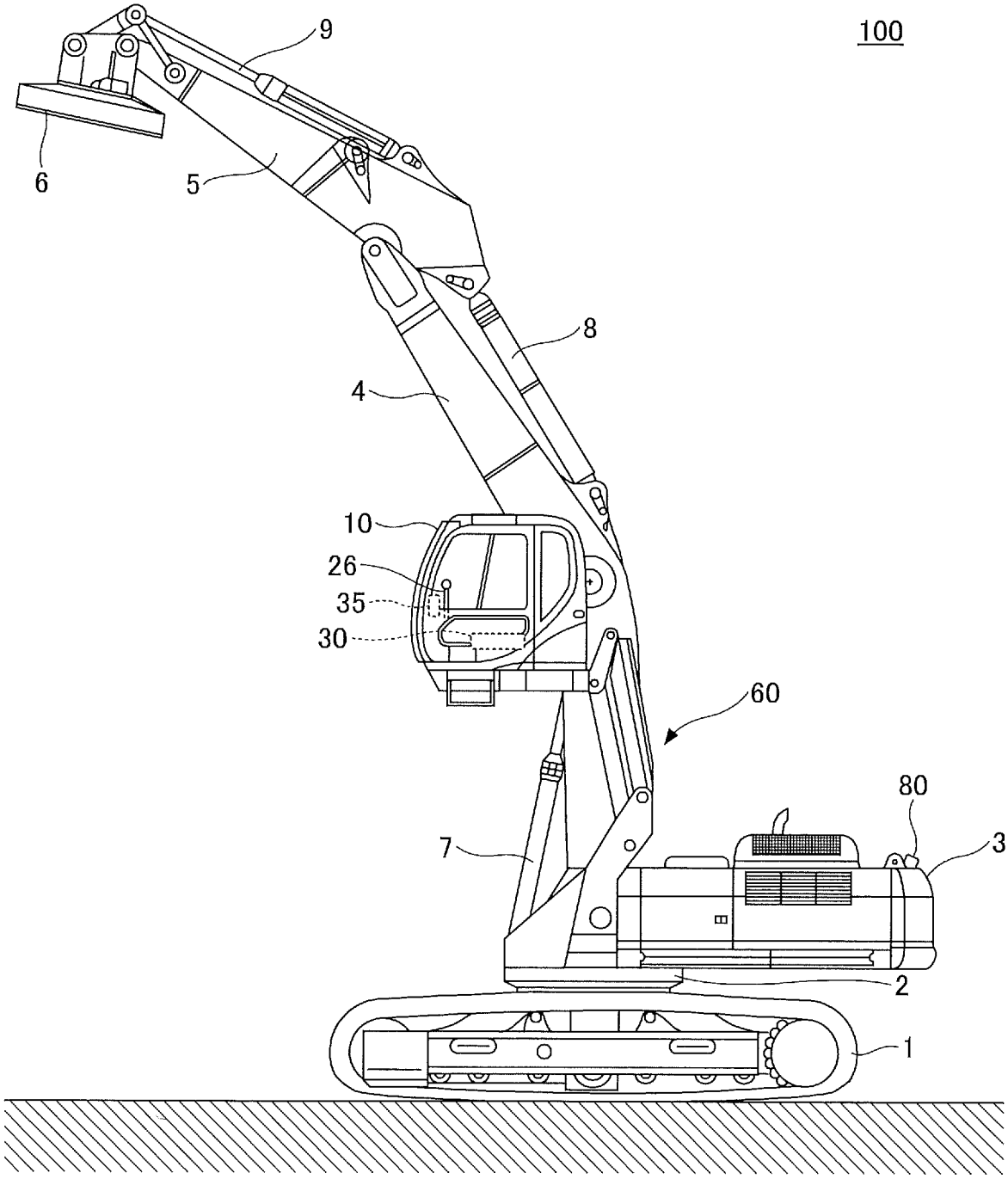
FIG. 1 is an overall schematic diagram of a work machine according to an embodiment.

An embodiment of the invention is described below with reference to the drawings. FIG. 1 is an overall schematic diagram of a work machine according to this embodiment.

A work machine 100 includes a lower traveling structure 1, a swing mechanism 2, an upper swing structure 3, a boom 4, an arm 5, an end attachment 6, a boom cylinder 7, an arm cylinder 8, an end attachment cylinder 9, a cab (operator cabin) 10, an operating device 26, a controller (control device) 30, and a display 35. The operating device 26, the controller (control device) 30, and the display 35 are provided in the cab 10.

The upper swing structure 3 is swingably mounted on the lower traveling structure 1 of the work machine 100 via the swing mechanism 2. Furthermore, the boom 4 is pivotably connected to the front center of the upper swing structure 3. The arm 5 is pivotably connected to the distal end of the boom 4. The end attachment 6 is pivotably connected to the distal end of the arm 5. While the end attachment 6 is a lifting magnet according to this embodiment, another end attachment such as a grapple or a demolition fork may also be attached depending on the type of work.

Furthermore, the cab 10 is provided on the upper swing structure 3 in such a manner as to be vertically movable via a cab riser 60. Hereinafter, such a cab that can rise and lower may be referred to as "elevating cab." FIG. 1 illustrates the cab 10 moved up to its highest position by the cab riser 60. Furthermore, the cab 10 is positioned beside (normally, on the left side of) the boom 4.

Furthermore, a camera 80 or the like is attached to the upper swing structure 3. The camera 80 is an image capturing device that captures an image of an area surrounding the work machine 100. According to this embodiment, the camera 80 is one or more cameras attached to the upper swing structure 3.

The operating device 26 is a device that an operator uses to operate hydraulic actuators. The operating device 26 supplies hydraulic oil discharged by a pilot pump to the pilot ports of the respective corresponding flow control valves of hydraulic actuators through pilot lines. The method of controlling hydraulic actuators, however, may be configured as desired to the extent that hydraulic actuators are driven according to the amount of operation of the operating device 26, and is configured using an appropriate method. For example, the amount of driving of hydraulic actuators may be calculated by the controller 30, which converts the amount of operation of the operating device 26 to other information such as voltage.

The controller 30 is a control device for controlling the work machine 100 and includes processing circuitry such as a computer including a CPU, a RAM, a ROM, and a non-volatile memory, for example. Furthermore, the controller 30 reads programs corresponding to various functional elements from the ROM, loads them into the RAM, and causes the CPU to execute processes corresponding to the various functional elements.

Figure 2:
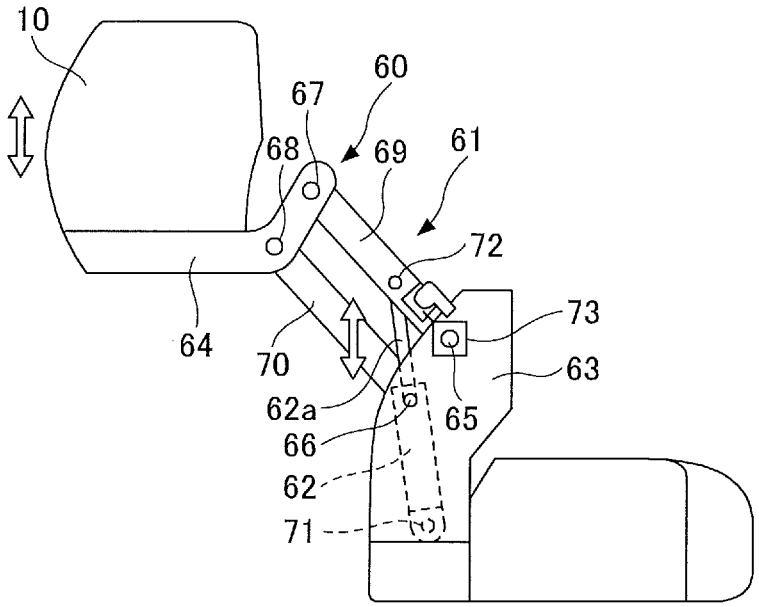
FIG. 2 is a diagram illustrating a cab riser of the work machine according to the embodiment.

Next, the cab riser 60 is described in detail with reference to FIG. 2. FIG. 2 is a diagram illustrating the cab riser of the work machine according to this embodiment.

As illustrated in FIG. 2, the cab riser 60 includes a parallel link mechanism 61 that keeps the cab 10 in a predetermined position (a horizontal state) and a cab raising cylinder 62 that drives the parallel link mechanism 61 to drive the cab 10 to rise and lower.

The parallel link mechanism 61 includes a support tower structure 63 that stands on the upper swing structure 3, an L-shaped platform 64 supporting the cab 10 from the lower side, and an upper link 69 and a lower link 70 pivotably connected between the support tower structure 63 and the platform 64. Specifically, the platform 64 is provided on the lower side of the cab 10 as a one-piece structure with the cab 10.

Furthermore, the upper link 69 has its upper end connected to the platform 64 via an upper end pin 67 and has its lower end connected to the support tower structure 63 via a lower end pin 65. The lower link 70 has its upper end connected to the platform 64 via an upper end pin 68 and has its lower end connected to the support tower structure 63 via a lower end pin 66. Although not depicted in FIG. 2, which is a side view, the upper link 69 and the lower link 70 are constituted of respective pairs of left and right links.

The cab raising cylinder 62 controls the pivoting of the upper link 69 and the lower link 70. Specifically, the proximal end of the cab raising cylinder 62 is pivotably supported at a lower portion of the support tower structure 63 via a cylinder pin 71. Furthermore, the distal end of a rod 62*a* of the cab raising cylinder 62 is connected to a connection member (not depicted) between the left and right upper links 69 via a rod pin 72.

According to this configuration, hydraulic oil is supplied from a hydraulic pump to the cab raising cylinder 62 to drive the cab riser 60 to rise and lower. Specifically, the cab riser 60 can move the cab 10 up and down while causing the upper link 69 and the lower link 70 to draw circular arcs with the lower end pins 65 and 66 serving as pivot points by extending and retracting the cab raising cylinder 62. The cab 10 can also move forward and backward in addition to moving upward and downward.

The cab riser 60 includes an angle sensor 73. Specifically, the angle sensor 73 is provided at one end of the pivot shaft of the lower end pin 65 to detect the pivot angle of the upper link 69 from its initial position. The initial position is a position when the cab 10 is at its lowest position. The angle sensor 73 is provided to prevent the cab 10 and the end attachment 6 from interfering with each other.

Specifically, the position of the cab 10 is calculated based on an angle detected by the angle sensor 73, and interference avoidance control is performed when it is determined that the relative distance between the cab 10 and the end attachment 6 in the front-to-back direction is less than a predetermined distance. According to the interference avoidance control, for example, the boom 4, the arm 5, etc., are controlled to move slowly irrespective of the operator's operation.

The angle sensor 73 may be any angle sensor, and for example, a rotary potentiometer or the like is used. Furthermore, the angle sensor 73 may also be provided at one end of the pivot shaft of the lower end pin 66 of the lower link 70 to detect the pivot angle of the lower link 70 from its initial position.

Figure 3:
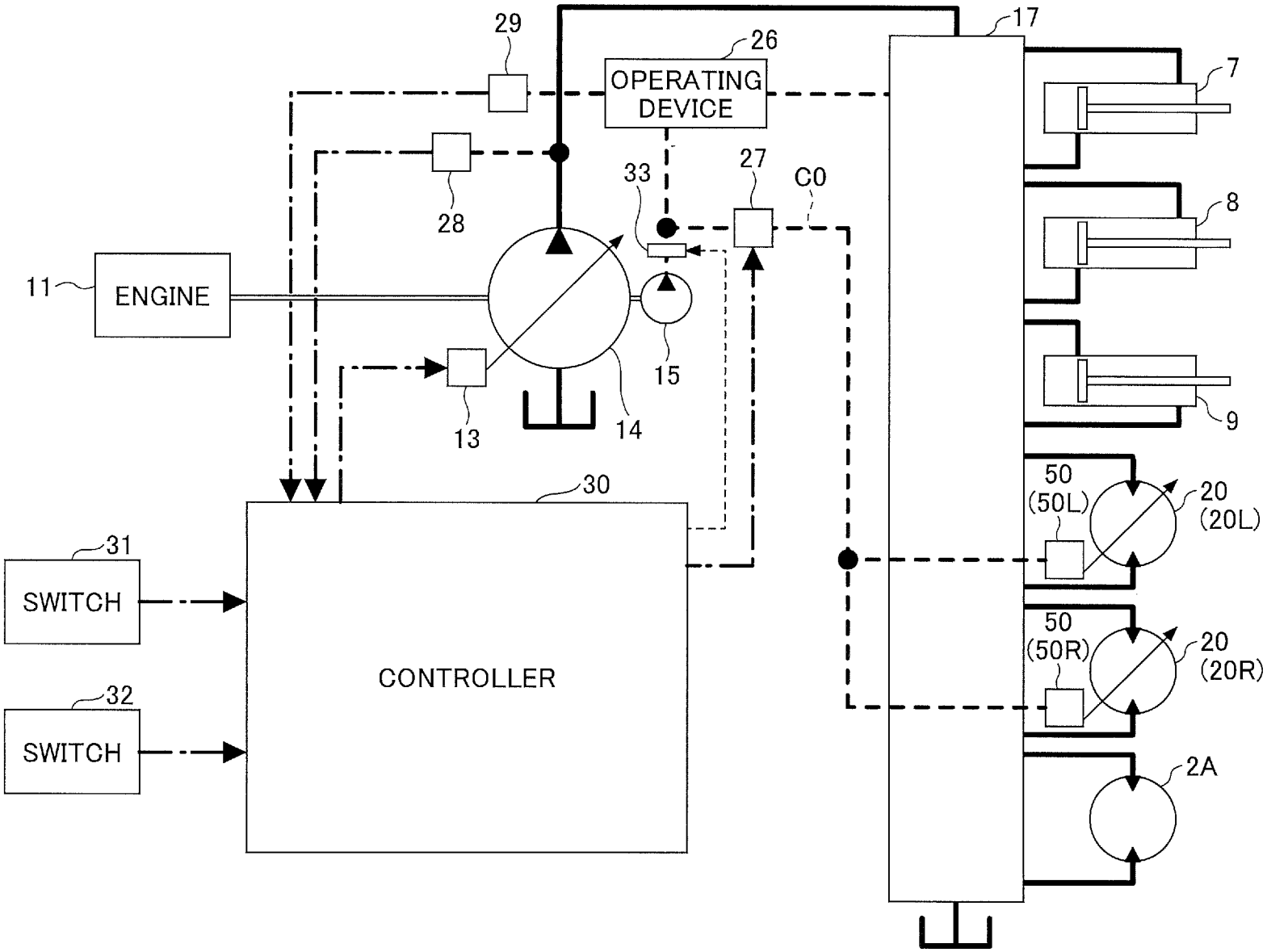
FIG. 3 is a diagram illustrating an example configuration of the basic system of the work machine according to the embodiment.

Next, a basic system of the work machine 100 according to this embodiment is described with reference to FIG. 3. FIG. 3 is a diagram illustrating an example configuration of the basic system of the work machine according to this embodiment.

In FIG. 3, a mechanical power transmission line, a hydraulic oil line, a pilot line, and an electric control line are indicated by a double line, a solid line, a dashed line, and a one-dot chain line, respectively. The same applies to FIGS. 4 and 5.

The basic system of the work machine 100 mainly includes an engine 11, a pump regulator 13, a main pump 14, a control pump 15, a control valve 17, the operating device 26, a solenoid valve 27, a discharge pressure sensor 28, an operating pressure sensor 29, the controller 30, a switch 31, a switch 32, and motor regulators 50.

The engine 11 is the drive source of the work machine 100. According to this embodiment, the engine 11 is, for example, a diesel engine serving as an internal combustion engine that operates to maintain a predetermined rotational speed. The output shaft of the engine 11 is connected to the input shafts of the main pump 14 and the control pump 15.

The main pump 14 is a device for supplying hydraulic oil to the control valve 17 via a hydraulic oil line, and is, for example, a swash plate variable displacement hydraulic pump.

The pump regulator 13 is a device for controlling the discharge quantity of the main pump 14. According to this embodiment, the pump regulator 13 controls the discharge quantity of the main pump 14 by, for example, adjusting the swash plate tilt angle of the main pump 14 according to the discharge pressure of the main pump 14, a command current from the controller 30, etc.

The control pump 15 is a device that supplies hydraulic oil to various kinds of hydraulic control devices including the operating device 26, and is, for example, a fixed displacement hydraulic pump.

The control valve 17 is a hydraulic control device that controls a hydraulic system in the work machine 100.

Specifically, the control valve 17 includes multiple control valves that control the flow of hydraulic oil discharged by the main pump 14. The control valve 17 selectively supplies hydraulic oil discharged by the main pump 14 to one or more hydraulic actuators through the control valves. The control valves control the flow rate of hydraulic oil flowing from the main pump 14 to the hydraulic actuators and the flow rate of hydraulic oil discharged from the hydraulic actuators to a hydraulic oil tank.

The hydraulic actuators include the boom cylinder 7, the arm cylinder 8, the end attachment cylinder 9, travel hydraulic motors 20, and a swing hydraulic motor 2A. The travel hydraulic motors 20 include a left travel hydraulic motor 20L and a right travel hydraulic motor 20R.

The operating device 26 is a device that the operator uses to operate the hydraulic actuators. According to this embodiment, the operating device 26 is a hydraulic type and supplies hydraulic oil discharged by the control pump 15 to the pilot ports of the respective corresponding control valves of the hydraulic actuators through pilot lines.

The pressure of hydraulic oil supplied to each pilot port (hereinafter "pilot pressure") is a pressure commensurate with the direction of operation and the amount of operation of a lever or pedal constituting the operating device 26 corresponding to an individual hydraulic actuator. The operating device 26 may also be an electric type.

The solenoid valve 27 is placed in a conduit CO between the control pump 15 and the motor regulators 50. According to this embodiment, the solenoid valve 27 is a solenoid selector valve that switches the opening and closing of the conduit CO, and operates in response to a command from the controller 30.

A pressure reducing valve 33 is placed in a conduit between the control pump 15, and the operating device 26 and the solenoid valve 27. According to this embodiment, the pressure reducing valve 33 reduces a pilot pressure and operates in response to a command from the controller 30.

The discharge pressure sensor 28 is a sensor for detecting the discharge pressure of the main pump 14 and outputs a detected value to the controller 30.

The operating pressure sensor 29 detects the details of the operator's operation using the operating device 26. According to this embodiment, the operating pressure sensor 29 is, for example, a pressure sensor that detects the direction of operation and the amount of operation of a lever or pedal constituting the operating device 26 corresponding to an individual hydraulic actuator in the form of pressure, and outputs a detected value to the controller 30.

The details of operation of the operating device 26 may also be detected using the output of a device other than a pressure sensor, such as an operating angle sensor, an acceleration sensor, an angular velocity sensor, a resolver, a voltmeter, or an ammeter. That is, the amount of operation of the operating device 26 may be expressed as not only an operating pressure but also an operating angle, the two integral value of operating acceleration, the integral value of operating angular velocity, a voltage value, a current value, or the like.

The controller 30 is a control device for controlling the work machine 100. According to this embodiment, the controller 30 is constituted of a computer including a CPU, a volatile storage device, and a non-volatile storage device, for example. The controller 30, for example, causes the CPU to execute programs corresponding to various functional elements such as a traveling mode control part 300.

The switch 31 is a switch for switching the operating mode (traveling mode) of the motor regulators 50. According to this embodiment, the switch 31 is a software switch displayed on an in-vehicle display with a touchscreen. The switch 31 may also be a hardware switch installed in the cab 10.

The switch 32 is a switch for switching the operation of elevating the cab 10 and the operation of lowering the cab 10. The switch 32 may be, for example, a hardware switch installed in the cab 10, and switches the raising and the lowering of the cab 10 according to operation. Furthermore, according to this embodiment, the position of the cab 10 does not move without the operation of the switch 32.

The motor regulators 50 control the displacements of the travel hydraulic motors 20. According to this embodiment, the motor regulators 50 include a left motor regulator 50L and a right motor regulator 50R. The left motor regulator 50L controls the motor displacement of the left travel hydraulic motor 20L by adjusting the swash plate tilt angle of the left travel hydraulic motor 20L according to a control pressure generated by hydraulic oil supplied through the solenoid valve 27. The same is the case with the right motor regulator 50R.

Specifically, the left motor regulator 50L can choose the motor displacement of the left travel hydraulic motor 20L between the two levels of a high rotation setting and a low rotation setting by choosing the swash plate tilt angle of the left travel hydraulic motor 20L between two levels.

The low rotation setting is implemented by increasing the motor displacement. In this case, the left travel hydraulic motor 20L operates with low rotation and high torque. The high rotation setting is implemented by decreasing the motor displacement. In this case, the left travel hydraulic motor 20L operates with high rotation and low torque. The same is the case with the right motor regulator 50R.

The controller 30 executes various processes as described below based on the outputs of the discharge pressure sensor 28, the operating pressure sensor 29, the switch 31, etc., for example. Functions of the controller 30 are described in detail below.

Figure 4:
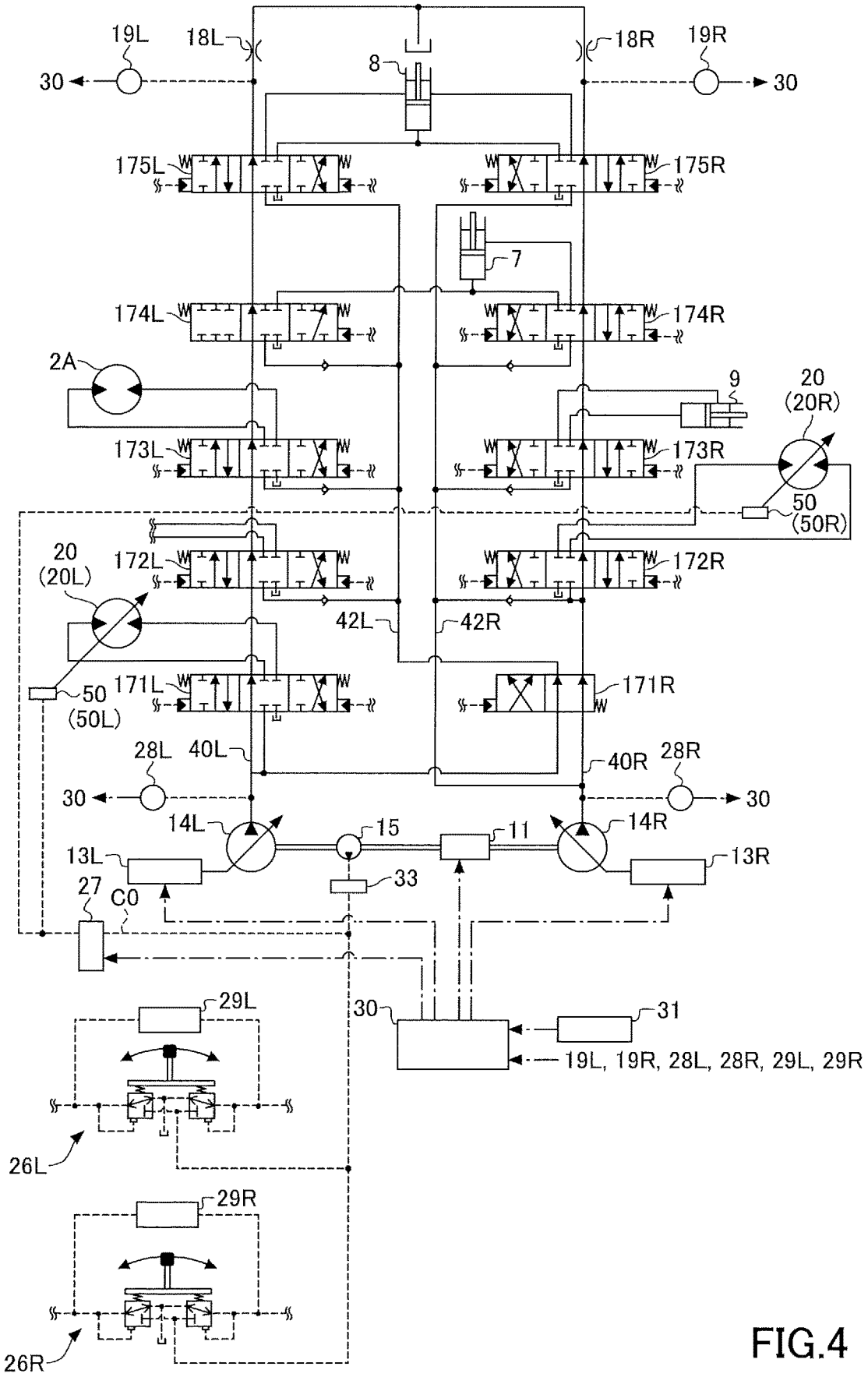
FIG. 4 is a schematic diagram illustrating an example configuration of a hydraulic system installed in the work machine of FIG. 1.

Next, a hydraulic system installed in the work machine 100 is described with reference to FIG. 4. FIG. 4 is a schematic diagram illustrating an example configuration of a hydraulic system installed in the work machine of FIG. 1. The hydraulic system of FIG. 4 circulates hydraulic oil from main pumps 14L and 14R driven by the engine 11 to the hydraulic oil tank via center bypass conduits 40L and 40R and parallel conduits 42L and 42R. The main pumps 14L and 14R correspond to the main pump 14 of FIG. 3.

The center bypass conduit 40L is a hydraulic oil line passing through control valves 171L through 175L arranged in the control valve 17. The center bypass conduit 40R is a hydraulic oil line passing through control valves 171R through 175R arranged in the control valve 17.

The control valve 171L is a spool valve that switches the flow of hydraulic oil to supply hydraulic oil discharged by the main pump 14L to the left travel hydraulic motor 20L and discharge hydraulic oil discharged by the left travel hydraulic motor 20L to the hydraulic oil tank.

The control valve 171R is a spool valve serving as a straight traveling valve. The control valve 171R switches the flow of hydraulic oil so that the hydraulic oil is supplied from the main pump 14L to each of the left travel hydraulic motor 20L and the right travel hydraulic motor 20R in order to increase the straightness of traveling of the lower traveling structure 1. Specifically, when the travel hydraulic motors 20 and any other hydraulic actuator are simultaneously operated, the control valve 171R is switched so that the main pump 14L can supply hydraulic oil to each of the left travel hydraulic motor 20L and the right travel hydraulic motor 20R. When no other hydraulic actuators are operated, the control valve 171R is switched so that the main pump 14L can supply hydraulic oil to the left travel hydraulic motor 20L and the main pump 14R can supply hydraulic oil to the right travel hydraulic motor 20R.

The control valve 172L is a spool valve that switches the flow of hydraulic oil to supply hydraulic oil discharged by the main pump 14L to an optional hydraulic actuator and discharge hydraulic oil discharged by the optional hydraulic actuator to the hydraulic oil tank. The optional hydraulic actuator is, for example, a grapple opening and closing cylinder.

The control valve 171R is a spool valve that switches the flow of hydraulic oil to supply hydraulic oil discharged by the main pump 14R to the right travel hydraulic motor 20R and discharge hydraulic oil discharged by the right travel hydraulic motor 20R to the hydraulic oil tank.

The control valve 173L is a spool valve that switches the flow of hydraulic oil to supply hydraulic oil discharged by the main pump 14L to the swing hydraulic motor 2A and discharge hydraulic oil discharged by the swing hydraulic motor 2A to the hydraulic oil tank.

The control valve 173R is a spool valve that switches the flow of hydraulic oil to supply hydraulic oil discharged by the main pump 14R to the end attachment cylinder 9 and discharge hydraulic oil in the end attachment cylinder 9 to the hydraulic oil tank.

The control valves 174L and 174R are spool valves that switch the flow of hydraulic oil to supply hydraulic oil discharged by the main pumps 14L and 14R to the boom cylinder 7 and discharge hydraulic oil in the boom cylinder 7 to the hydraulic oil tank. According to this embodiment, the control valve 174L operates only when an operation to raise the boom 4 is performed, and does not operate when an operation to lower the boom 4 is performed.

The control valves 175L and 175R are spool valves that switch the flow of hydraulic oil to supply hydraulic oil discharged by the main pumps 14L and 14R to the arm cylinder 8 and discharge hydraulic oil in the arm cylinder 8 to the hydraulic oil tank.

The parallel conduit 42L is a hydraulic oil line parallel to the center bypass conduit 40L. When the flow of hydraulic oil through the center bypass conduit 40L is restricted or blocked by any of the control valves 171L through 174L, the parallel conduit 42L can supply hydraulic oil to a control valve further downstream. The parallel conduit 42R is a hydraulic oil line parallel to the center bypass conduit 40R. When the flow of hydraulic oil through the center bypass conduit 40R is restricted or blocked by any of the control valves 172R through 174R, the parallel conduit 42R can supply hydraulic oil to a control valve further downstream.

Pump regulators 13L and 13R control the discharge quantities of the main pumps 14L and 14R by adjusting the swash plate tilt angles of the main pumps 14L and 14R according to the discharge pressures of the main pumps 14L and 14R. The pump regulators 13L and 13R correspond to the pump regulator 13 of FIG. 3. The pump regulators 13L and 13R decrease the discharge quantities of the main pumps 14L and 14R by adjusting their swash plate tilt angles when the discharge pressures of the main pumps 14L and 14R increase, for example. This is for preventing the absorbed power of the main pump 14 expressed as the product of discharge pressure and discharge quantity from exceeding the output power of the engine 11.

A left travel operating device 26L and a right travel operating device 26R are examples of the operating device 26, and are constituted of a travel operating lever and a travel operating pedal in combination.

The left travel operating device 26L is used to operate the left travel hydraulic motor 20L. The left travel operating device 26L uses hydraulic oil discharged by the control pump 15 to cause a pilot pressure commensurate with the amount of operation to act on a pilot port of the control valve 171L. Specifically, the left travel operating device 26L causes a pilot pressure to act on the left pilot port of the control valve 171L when operated in the forward traveling direction and causes a pilot pressure to act on the right pilot port of the control valve 171L when operated in the backward traveling direction.

The right travel operating device 26R is used to operate the right travel hydraulic motor 20R. The right travel operating device 26R uses hydraulic oil discharged by the control pump 15 to cause a pilot pressure commensurate with the amount of operation to act on a pilot port of the control valve 172R. Specifically, the right travel operating device 26R causes a pilot pressure to act on the right pilot port of the control valve 172R when operated in the forward traveling direction and causes a pilot pressure to act on the left pilot port of the control valve 172R when operated in the backward traveling direction.

In response to having received a communication command from the controller 30, the solenoid valve 27 causes the control pump 15 to communicate with the motor regulators 50. In this case, the motor regulators 50 operate in a forced fixed mode. In response to receiving no communication command from the controller 30, the solenoid valve 27 interrupts the communication between the control pump 15 and the motor regulators 50. In this case, the motor regulators 50 operate in a variable mode.

The pressure reducing valve 33 controls the amount of stroke (the amount of movement) of the spool of each of the control valves 171L and 172R in response to a command from the controller 30. According to this embodiment, the pressure reducing valve 33 is not always necessary in the case of executing a flow rate reducing process with the travel hydraulic motors 20, the main pump 14, the engine 11, etc.

Discharge pressure sensors 28L and 28R are examples of the discharge pressure sensor 28 of FIG. 3. The discharge pressure sensor 28L detects the discharge pressure of the main pump 14L and outputs a detected value to the controller 30. The discharge pressure sensor 28R detects the discharge pressure of the main pump 14R and outputs a detected value to the controller 30.

Operating pressure sensors 29L and 29R are examples of the operating pressure sensor 29 of FIG. 3. The operating pressure sensor 29L detects the details of the operator's operation on the left travel operating device 26L in the form of pressure, and outputs a detected value to the controller 30. The operating pressure sensor 29R detects the details of the operator's operation on the right travel operating device 26R in the form of pressure, and outputs a detected value to the controller 30. Examples of the details of operation include the direction of operation and the amount of operation (the angle of operation).

A boom operating lever, an arm operating lever, a bucket operating lever, and a swing operating lever (none of which is depicted) are operating devices for performing operations for raising and lowering the boom 4, opening and closing the arm 5, opening and closing the end attachment 6, and swinging the upper swing structure 3. The same as the left travel operating device 26L, these operating devices use hydraulic oil discharged by the control pump 15 to cause a pilot pressure commensurate with the amount of lever operation to act on the left or right pilot port of a control valve corresponding to an individual hydraulic actuator. Furthermore, the same as in the case of the operating pressure sensor 29L, the details of the operator's operation on each of these operating devices are detected by a corresponding operating pressure sensor in the form of pressure, and a detected value is output to the controller 30.

Here, negative control (hereinafter "NC control") adopted in the hydraulic system of FIG. 4 is described.

The center bypass conduits 40L and 40R include negative control throttles 18L and 18R between the respective most downstream control valves 175L and 175R and the hydraulic oil tank. The flow of hydraulic oil discharged by the main pumps 14L and 14R is restricted by the negative control throttles 18L and 18R. The negative control throttles 18L and 18R generate control pressures (hereinafter "NC pressures") for controlling the pump regulators 13L and 13R.

NC pressure sensors 19L and 19R are sensors that detect the NC pressures generated upstream of the negative control throttles 18L and 18R. According to this embodiment, the NC pressure sensors 19L and 19R output detected values to the controller 30.

The controller 30 outputs commands according to the NC pressures to the pump regulators 13L and 13R. The pump regulators 13L and 13R control the discharge quantities of the main pumps 14L and 14R by adjusting the swash plate tilt angles of the main pumps 14L and 14R according to the commands. Specifically, the pump regulators 13L and 13R decrease the discharge quantities of the main pumps 14L and 14R as the NC pressures increase, and increase the discharge quantities of the main pumps 14L and 14R as the NC pressures decrease.

When none of the hydraulic actuators is operated, hydraulic oil discharged by the main pumps 14L and 14R arrives at the negative control throttles 18L and 18R through the center bypass conduits 40L and 40R. The flow of the hydraulic oil discharged by the main pumps 14L and 14R increases NC pressures generated upstream of the negative control throttles 18L and 18R. As a result, the pump regulators 13L and 13R decrease the discharge quantities of the main pumps 14L and 14R to minimum allowable discharge quantities to control pressure loss (pumping loss) during the passage of the discharged hydraulic oil through the center bypass conduits 40L and 40R.

In contrast, when any of the hydraulic actuators is operated, hydraulic oil discharged by the main pump 14L or 14R flows into the operated hydraulic actuator via a control valve corresponding to the operated hydraulic actuator. The flow of the hydraulic oil discharged by the main pump 14L or 14R that arrives at the negative control throttle 18L or 18R is reduced in amount or lost, so that the NC pressure generated upstream of the negative control throttle 18L or 18R decreases. As a result, the pump regulator 13L or 13R increases the discharge quantity of the main pump 14L or 14R to circulate sufficient hydraulic oil to the operated hydraulic actuator to ensure the driving of the operated hydraulic actuator.

The above-described configuration enables the hydraulic system of FIG. 4 to control unnecessary energy consumption in the main pumps 14L and 14R when none of the hydraulic actuators is operated. The unnecessary energy consumption includes pumping loss that hydraulic oil discharged by the main pumps 14L and 14R causes in the center bypass conduits 40L and 40R. It is ensured that when a hydraulic actuator is operated, necessary and sufficient hydraulic oil is supplied from the main pump 14L or 14R to the operated hydraulic actuator.

Figure 5:
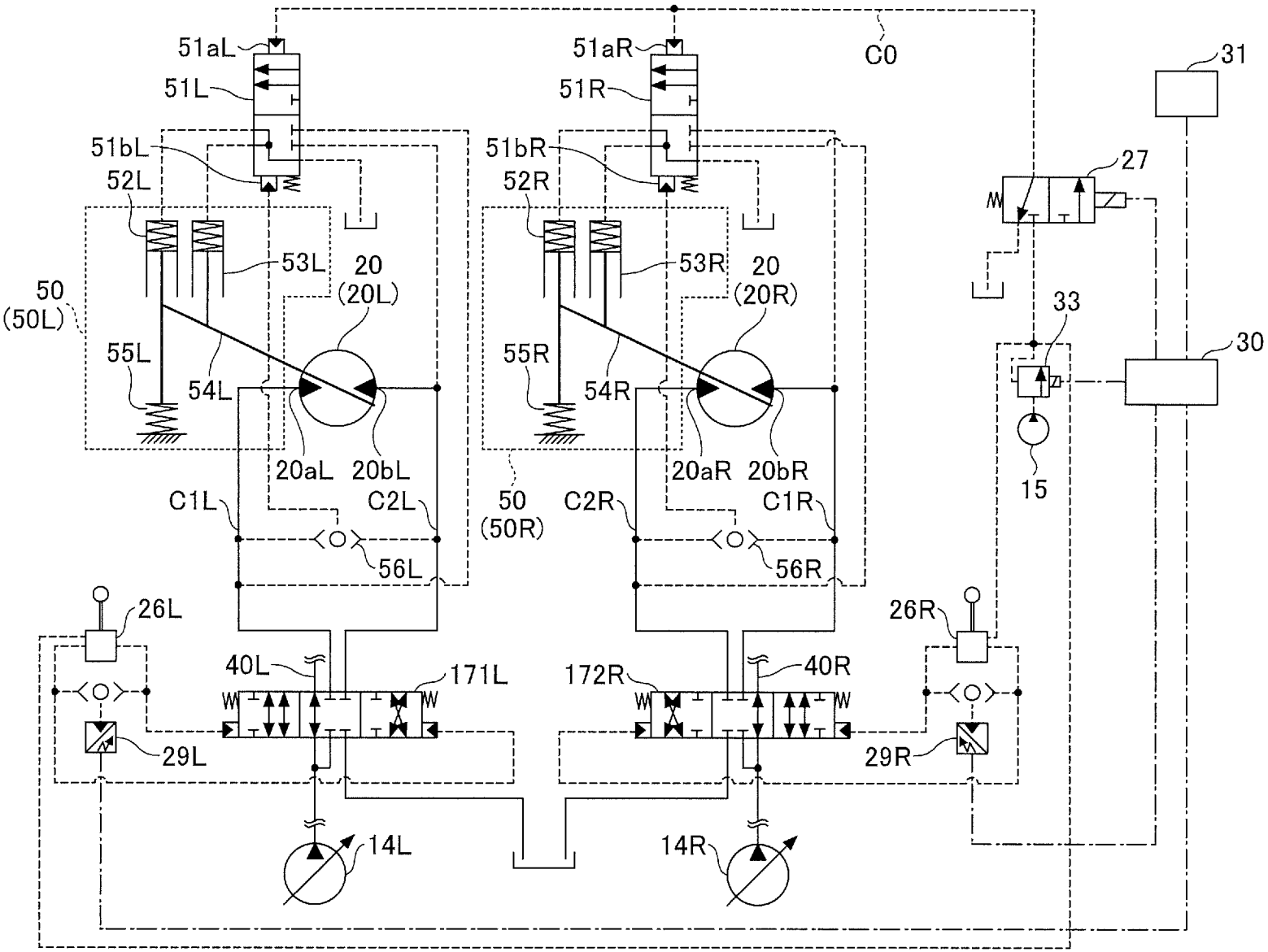
FIG. 5 is a diagram illustrating an example configuration of a hydraulic circuit associated with motor regulators.

Next, the motor regulators 50 are described with reference to FIG. 5. FIG. 5 is a diagram illustrating an example configuration of a hydraulic circuit associated with motor regulators. The motor regulators 50 include the left motor regulator 50L and the right motor regulator 50R. In the following, a description is given of the left motor regulator 50L. The same description is also applied to the right motor regulator 50R.

The left motor regulator 50L mainly includes a first cylinder 52L, a second cylinder 53L, a swash plate link mechanism 54L, and a spring 55L, and is connected to a setting selector valve 51L.

The setting selector valve 51L is a valve for choosing the motor displacement of the left travel hydraulic motor 20L between the two levels of the high rotation setting and the low rotation setting. A first port 51*a*L of the setting selector valve 51L is connected to the secondary side of the solenoid valve 27, and a second port 51*b*L of the setting selector valve 51L is connected to a shuttle valve 56L.

The shuttle valve 56L is configured to connect one of a conduit C1L and a conduit C2L that is higher in pressure to the second port 51*b*L of the setting selector valve 51L. The conduit C1L connects a first port 20*a*L of the left travel hydraulic motor 20L and the control valve 171L. The conduit C2L connects a second port 20*b*L of the left travel hydraulic motor 20L and the control valve 171L.

The setting selector valve 51L has a first valve position and a second valve position. The first valve position corresponds to the low rotation setting, and the second valve position corresponds to the high rotation setting. FIG. 5 illustrates the setting selector valve 51L in the first valve position.

In the first valve position, the setting selector valve 51L causes each of the first cylinder 52L and the second cylinder 53L to communicate with the hydraulic oil tank. In the second valve position, the setting selector valve 51L causes the first cylinder 52L to communicate with the conduit C1L and causes the second cylinder 53L to communicate with the conduit C2L.

The first cylinder 52L and the second cylinder 53L are hydraulic actuators that operate the swash plate link mechanism 54L. When connected to the hydraulic oil tank via the setting selector valve 51L, the first cylinder 52L and the second cylinder 53L discharge hydraulic oil in the cylinders to retract to operate the swash plate link mechanism 54L in a direction to increase the swash plate tilt angle.

As a result, according to this embodiment, the motor displacement of the left travel hydraulic motor 20L is maximized. In contrast, when connected to the conduits C1L and C2L via the setting selector valve 51L, the first cylinder 52L and the second cylinder 53L receive hydraulic oil into the cylinders to extend to operate the swash plate link mechanism 54L in a direction to decrease the swash plate tilt angle. As a result, according to this embodiment, the motor displacement of the left travel hydraulic motor 20L is minimized.

The spring 55L urges the swash plate link mechanism 54L in the direction to increase the swash plate tilt angle. When connected to the hydraulic tank via the setting selector valve 51L, the extended first cylinder 52L and second cylinder 53L retract while discharging hydraulic oil in the cylinders because of the restoring force of the spring 55L. As a result, the swash plate link mechanism 54L moves in the direction to increase the swash plate tilt angle to minimize the motor displacement of the left travel hydraulic motor 20L.

Figure 6:
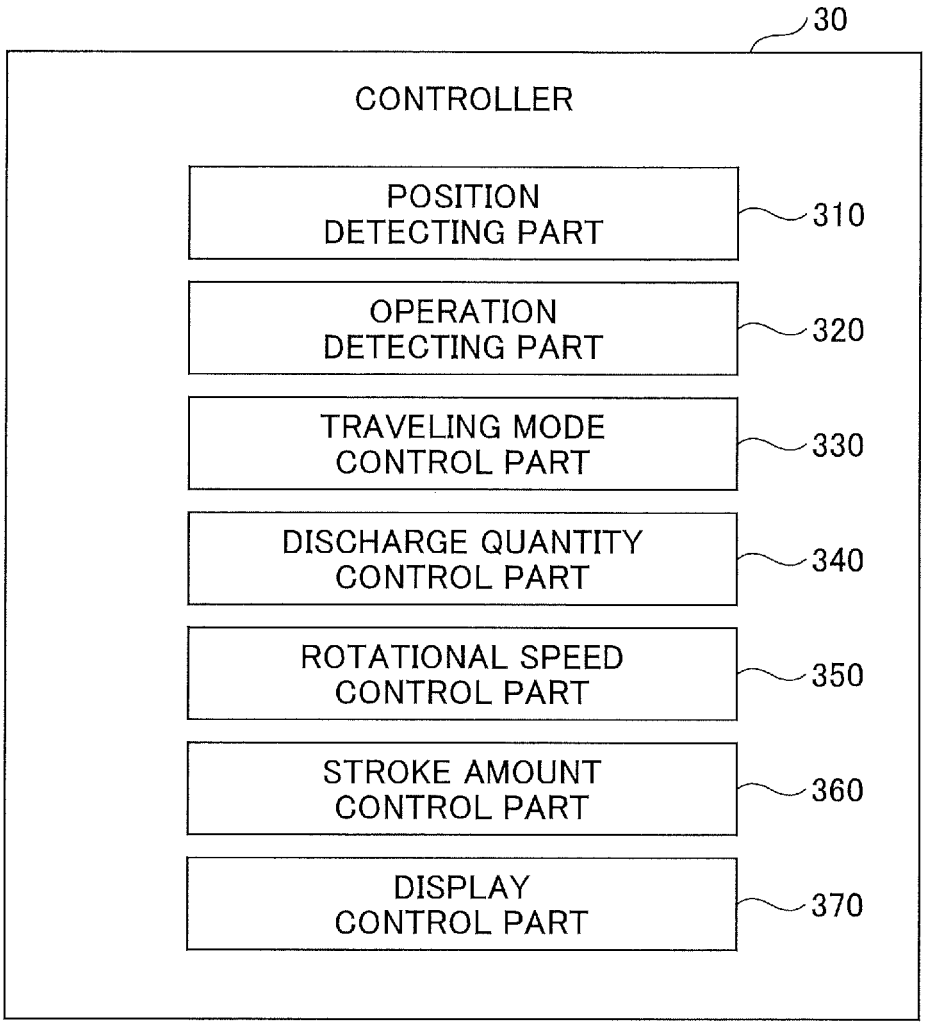
FIG. 6 is a diagram illustrating a functional configuration of a controller.

Next, a functional configuration of the controller 30 according to this embodiment is described with reference to FIG. 6. FIG. 6 is a diagram illustrating a functional configuration of a controller.

The functions of the parts illustrated in FIG. 6 are implemented by the CPU of the controller 30 reading and executing programs stored in a storage such as the ROM.

The controller 30 according to this embodiment includes a position detecting part 310, an operation detecting part 320, the traveling mode control part 330, a discharge quantity control part 340, a rotational speed control part 350, a stroke amount control part 360, and a display control part 370.

The position detecting part 310 detects the position of the cab 10. The height of the cab 10 may be relative to the height of the cab in the state where the lowering of the cab 10 is completed.

Specifically, the position detecting part 310 according to this embodiment may detect the height of the cab 10 based on the output of the angle sensor 73.

Furthermore, the position detecting part 310 according to this embodiment may also detect the position of the cab 10 based on an operation on the switch 32. For example, the position detecting part 310 may detect the position (height) of the cab 10 according to the duration of a command to elevate the cab 10 input from the switch 32.

The operation detecting part 320 detects an operation commanded for the work machine 100. Specifically, the operation detecting part 320 detects an operation to elevate the cab 10 and an operation to lower the cab 10 based on an operation on the switch 32. Furthermore, the operation detecting part 320 detects an operation to cause the work machine 100 to travel based on an operation on the operating device 26.

The traveling mode control part 330 controls the traveling mode of the motor regulators 50. According to this embodiment, the traveling mode includes the forced fixed mode (low speed mode) and the variable mode (high speed mode). In the forced fixed mode, the motor displacements of the travel hydraulic motors 20 are forcibly fixed to the low rotation setting. In the variable mode, the motor displacements can switch between the low rotation setting and the high rotation setting. The traveling mode may include a manual fixed mode. The manual fixed mode is, for example, a traveling mode that is set using the switch 31. In the manual fixed mode, the motor displacements are fixed to the low rotation setting the same as in the case of the forced fixed mode.

For example, when a predetermined condition is satisfied, the traveling mode control part 330 outputs a command to the solenoid valve 27 to communicate the control pump 15 with the motor regulators. When the control pump 15 and the motor regulators 50 communicate, the motor regulators 50 operate in the forced fixed mode. In this case, the left motor regulator 50L fixes the motor displacement of the left travel hydraulic motor 20L to the low rotation setting, and the right motor regulator 50R fixes the motor displacement of the right travel hydraulic motor 20R to the low rotation setting.

Furthermore, the traveling mode control part 330 according to this embodiment fixes the traveling mode to the low speed mode when an operation that commands traveling is detected by the operation detecting part 320 while the position of the cab 10 detected by the position detecting part 310 is higher than a predetermined position.

A value indicating a predetermined height may be prestored in a storage device of the controller 30. Furthermore, according to this embodiment, it may be determined that the position of the cab 10 is higher than a predetermined position when an angle detected by the angle sensor 73 is greater than or equal to a predetermined angle.

The traveling mode control part 330 according to this embodiment releases the traveling mode from the low speed mode when the position of the cab 10 detected by the position detecting part 310 becomes lower than or equal to the height of the predetermined position. That is, the traveling mode can be chosen between the high speed mode and the low speed mode in the work machine 100.

According to this embodiment, the traveling mode is thus fixed at low speed (maintained at low speed) when the work machine 100 travels with the cab 10 being elevated to a position above a predetermined height.

Thus, according to this embodiment, it is possible to reduce shaking during the traveling of the work machine 100 with the elevated cab 10.

Therefore, according to this embodiment, it is possible to reduce damage to a structure such as the cab riser 60 caused by shaking during traveling and control negative effects on the fatigue life of the structure caused by shaking during traveling.

Furthermore, according to this embodiment, when the cab 10 is elevated, traveling is performed at low speed. It is therefore possible to prevent an increase in the shaking of the cab 10 during traveling. Thus, according to this embodiment, it is possible to control the operator's fatigue and uncomfortable feeling due to shaking, so that it is possible to improve ride quality.

Furthermore, the discharge quantity control part 340 according to this embodiment may control the quantity of hydraulic oil discharged from the main pump 14 by controlling the pump regulator 13. Furthermore, the rotational speed control part 350 according this embodiment controls the rotational speed of the engine 11. The stroke amount control part 360 according to this embodiment may output a command to the pressure reducing valve 33 to control the amount of stroke of the spool of each of the control valves 171L and 172R.

Each of the discharge quantity control part 340, the rotational speed control part 350, and the stroke amount control part 360 according to this embodiment can fix the travel speed of the work machine 100 to low speed instead of the traveling mode control part 330 setting the traveling mode to the low speed mode.

For example, when an operation that commands traveling is detected while the position of the cab 10 is higher than a predetermined position, the discharge quantity control part 340 may restrict the quantity of hydraulic oil discharged from the main pump 14 so that the travel speed of the work machine 100 is fixed at low speed.

In other words, when an operation that commands traveling is detected while the cab 10 is at a position higher than a predetermined position, the discharge quantity control part 340 may restrict the flow rate of the main pump 14 to a predetermined proportion or less of the unrestricted flow rate.

The discharge quantity control part 340 removes the restriction on the discharge quantity when the position of the cab 10 becomes lower than or equal to the height of the predetermined position.

This makes it possible to produce the same effects as in the case where the traveling mode is set to the low speed mode by the traveling mode control part 330.

Furthermore, when an operation that commands traveling is detected while the position of the cab 10 is higher than a predetermined position, the rotational speed control part 350 may restrict the rotational speed of the engine 11 so that the travel speed of the work machine 100 is fixed at low speed.

In other words, when an operation that commands traveling is detected while the cab 10 is at a position higher than a predetermined position, the rotational speed control part 350 may restrict the rotational speed of the engine 11 to a predetermined proportion or less of the unrestricted rotational speed.

The rotational speed control part 350 removes the restriction on the rotational speed when the position of the cab 10 becomes lower than or equal to the height of the predetermined position.

This makes it possible to produce the same effects as in the case where the traveling mode is set to the low speed mode by the traveling mode control part 330.

Furthermore, when an operation that commands traveling is detected while the position of the cab 10 is higher than a predetermined position, the stroke amount control part 360 outputs a command to the pressure reducing valve 33 to restrict the amount of stroke of the spool of each of the control valves 171L and 172R so that the travel speed of the work machine 100 is fixed at low speed.

In other words, when an operation that commands traveling is detected while the cab 10 is at a position higher than a predetermined position, the stroke amount control part 360 may restrict the amount of stroke of the spool of each of the control valves 171L and 172R to a predetermined proportion or less of the unrestricted amount of stroke.

The stroke amount control part 360 removes the restriction on the amount of stroke when the position of the cab 10 becomes lower than or equal to the height of the predetermined position.

This makes it possible to produce the same effects as in the case where the traveling mode is set to the low speed mode by the traveling mode control part 330.

According to this embodiment, the control for fixing the travel speed of the work machine 100 at low speed may be executed by one of the traveling mode control part 330, the discharge quantity control part 340, the rotational speed control part 350, and the stroke amount control part 360. Furthermore, the control part used for this control may be preset or may be determined by the controller 30 according to the state of the work machine 100.

The display control part 370 according to this embodiment controls display on the display 35 provided in the cab 10.

Specifically, the display control part 370 according to this embodiment displays a message indicating that the traveling mode is fixed to the low speed mode on the display 35 when the traveling mode is fixed to the low speed mode by the traveling mode control part 330.

Figure 7:
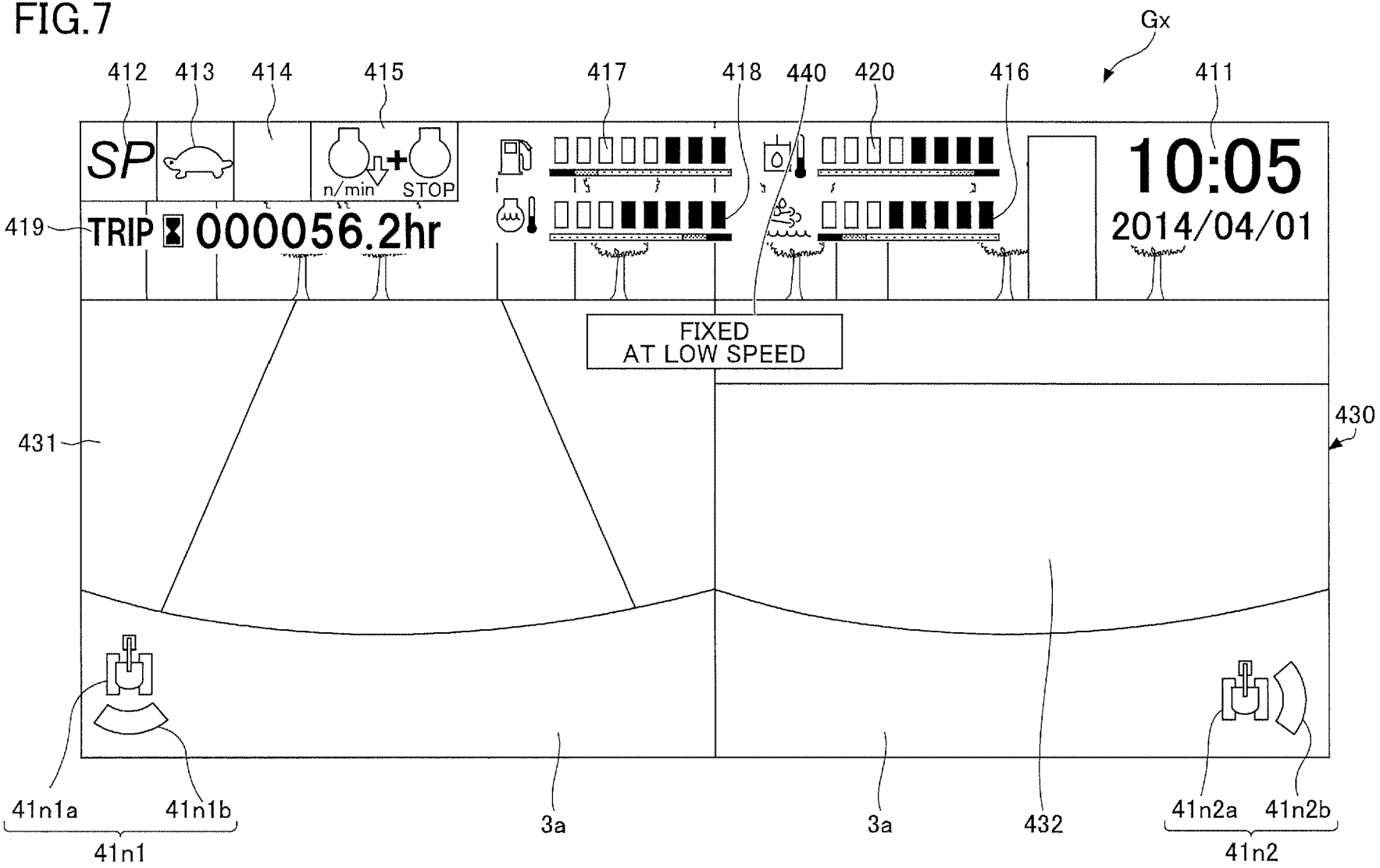
FIG. 7 is a diagram illustrating an example of an output image displayed on a display.

Next, a display example of the display 35 of the work machine 100 is described with reference to FIG. 7. FIG. 7 is a diagram illustrating an example of an output image displayed on a display.

As illustrated in FIG. 7, on a display screen Gx displayed on the display 35, each of a time display area 411, a rotational speed mode display area 412, a traveling mode display area 413, an attachment display area 414, and an engine control status display area 415 is an example of a settings display area in which the settings of the work machine 100 are displayed. Each of a remaining aqueous urea solution amount display area 416, a remaining fuel amount display area 417, a coolant water temperature display area 418, an engine operating time display area 419, and a hydraulic oil temperature display area 420 is an example of an operating condition display area in which the operating condition of the work machine 100 is displayed.

Furthermore, on the display screen Gx, a camera image display area 430 is divided laterally into two. An image captured by a back monitoring camera 80B is displayed in a left camera image display area 431, and an image captured by a right side monitoring camera 80R is displayed in a right camera image display area 432. Furthermore, in FIG. 7, various kinds of operating information are superimposed and displayed over the captured images in an upper area of the display screen Gx.

Images displayed in the parts are generated from various data transmitted from the controller 30 and camera images transmitted from the camera 80.

Each camera is installed such that captured image data include at least part of a cover 3*a* of the upper swing structure 3. The inclusion of part of the cover 3*a* in the displayed image allows the operator to have a better sense of distance between an object displayed in the camera image display area 430 and the work machine 100.

The time display area 411 displays a current time. In the illustration of FIG. 7, digital display is employed, and the current time (10:05) is shown.

The rotational speed mode display area 412 displays a rotational speed mode set by an engine rotational speed adjustment dial (not depicted) provided in the cab 10 in image form as operating information of the work machine. The rotational speed mode includes four modes that are SP mode, H mode, A mode, and idling mode. According to the illustration of FIG. 7, a symbol "SP" representing SP mode is displayed.

The engine rotational speed adjustment dial allows the engine rotational speed to be selected from the four levels of SP mode, H mode, A mode, and idling mode.

The SP mode is a rotational speed mode selected when it is desired to prioritize workload, and uses the highest engine rotational speed. The H mode is a rotational speed mode selected when it is desired to balance workload and fuel efficiency, and uses the second highest engine rotational speed.

The A mode is a rotational speed mode selected when it is desired to operate the work machine at low noise while prioritizing fuel efficiency, and uses the third highest engine rotational speed.

The idling mode is a rotational speed mode selected when it is desired to idle the engine 11, and uses the lowest engine rotational speed. The engine 11 is controlled to a constant rotational speed at the engine rotational speed of the rotational speed mode set by the engine rotational speed adjustment dial.

The traveling mode display area 413 displays a traveling mode as operating information of the work machine 100. The traveling mode represents the setting of traveling hydraulic motors for which variable displacement motors are used.

For example, the traveling mode includes the low speed mode and the high speed mode. A "turtle"-shaped mark is displayed in the low speed mode, and a "rabbit"-shaped mark is displayed in the high speed mode. According to the illustration of FIG. 7, the "turtle"-shaped mark is displayed to make it possible for the operator to recognize that the low speed mode is set.

The attachment display area 414 displays an image representing the attached attachment as operating information of the work machine.

The end attachment 6 attached to the work machine 100 varies from a bucket to a rock drill, a grapple, a lifting magnet, etc. The attachment display area 414 displays, for example, marks shaped like these end attachments and numbers corresponding to the attachments.

According to the illustration of FIG. 7, a bucket is attached as the end attachment 6, and the attachment display area 414 is blank as illustrated in FIG. 7. When a rock drill is attached as the end attachment, for example, a rock drill-shaped mark is displayed together with a number representing the magnitude of the output of the rock drill in the attachment display area 414.

The engine control status display area 415 displays the control status of the engine 11 as operating information of the work machine 100. According to the illustration of FIG. 7, "automatic deceleration and automatic stop mode" is selected as the control status of the engine 11. The "automatic deceleration and automatic stop mode" means a control status to automatically reduce the engine rotational speed and further to automatically stop the engine 11 in accordance with the duration of a non-operating state. Other control statuses of the engine 11 include "automatic deceleration mode," "automatic stop mode," and "manual deceleration mode."

The remaining aqueous urea solution amount display area 416 displays the status of the remaining amount of an aqueous urea solution stored in an aqueous urea solution tank in image form as operating information of the work machine 100. According to the illustration of FIG. 7, a bar gauge representing the current status of the remaining amount of an aqueous urea solution is displayed. The remaining amount of an aqueous urea solution is displayed based on the output data of a remaining aqueous urea solution amount sensor provided in the aqueous urea solution tank.

The remaining fuel amount display area 417 displays the status of the remaining amount of fuel stored in a fuel tank as operating information. According to the illustration of FIG. 7, a bar gauge representing the current status of the remaining amount of fuel is displayed. The remaining amount of fuel is displayed based on the output data of a remaining fuel amount sensor provided in the fuel tank.

The coolant water temperature display area 418 displays the temperature condition of engine coolant water as operating information of the work machine. According to the illustration of FIG. 7, a bar gauge representing the temperature condition of engine coolant water is displayed. The temperature of engine coolant water is displayed based on the output data of a water temperature sensor provided on the engine 11.

The engine operating time display area 419 displays the cumulative operating time of the engine 11 as operating information of the work machine 100. According to the illustration of FIG. 7, a cumulative operating time since the restart of counting by the operator is displayed together with a unit "hr (hour)." A lifelong operating time in the entire period after the manufacture of the work machine 100 or a section operating time since the restart of counting by the operator is displayed in the engine operating time display area 419. The hydraulic oil temperature display area 420 is an area for displaying the temperature condition of hydraulic oil in the hydraulic oil tank. According to the illustration of FIG. 7, a bar graph representing the temperature condition of hydraulic oil is displayed. The temperature of hydraulic oil is displayed based on the output data of an oil temperature sensor.

Furthermore, in the camera image display area 430, an image capturing device icon 41*n* representing the orientation of the image capturing device 80 that has captured a captured image that is being displayed is displayed. The image capturing device icon 41*n* includes a work machine icon 41*na* representing the shape of the work machine 100 in a plan view and a strip-shaped orientation indicator icon 41*nb* representing the orientation of the image capturing device 80 that has captured the captured image that is being displayed.

In the left camera image display area 431, an image capturing device icon 41*n*1 is displayed, and an orientation indicator icon 41*n*1*b* is displayed below a work machine (shovel) icon 41*n*1*a*, indicating that a captured image captured by the back monitoring camera 80B is being displayed. Furthermore, in the right camera image display area 432, an image capturing device icon 41*n*2 is displayed, and an orientation indicator icon 41*n*2*b* is displayed to the right of a work machine (shovel) icon 41*n*2*a*, indicating that a captured image captured by the right side monitoring camera 80R is being displayed.

A captured image captured by a left side monitoring camera 80L may be displayed in the left camera image display area 431, and a captured image captured by the back monitoring camera 80B may be displayed in the right camera image display area 432. Furthermore, the camera image display area 430 may be divided into three, and an image captured by the left side monitoring camera 80L, an image captured by the back monitoring camera 80B, and an image captured by the right side monitoring camera 80R may be displayed in the left area, the central area, and the right area, respectively.

Furthermore, a composite image of multiple camera images captured by at least two among the left side monitoring camera 80L, the back monitoring camera 80B, and the right side monitoring camera 80R may be displayed in the camera image display area 430. The composite image may be, for example, an overhead view image.

For example, by pressing an image change switch provided in the cab 10, the operator can switch an image to display in the camera image display area 430 to an image captured by another camera, or the like.

When the camera 80 is not provided on the work machine 100, different information may be displayed instead of the camera image display area 430.

Furthermore, on the display screen Gx, a message display area 440 displays a message indicating that the travel speed of the work machine 100 is fixed at low speed.

According to the illustration of FIG. 7, a message "FIXED AT LOW SPEED" is displayed. According to this embodiment, when the control for fixation to low speed is executed by the traveling mode control part 330, a message "FIXED TO LOW SPEED MODE" may be displayed.

According to this embodiment, by displaying such a message, it is possible to cause the operator to recognize that the travel speed of the work machine 100 is fixed at low speed.

The above-described embodiment may be applied to any work machine to the extent that the work machine includes an elevating cab.

A preferred embodiment of the present invention is described in detail above. The present invention, however, is not limited to the above-described embodiment, and variations and substitutions may be added to the above-described embodiment without departing from the scope of the present invention.

What is claimed is:

1. A work machine comprising:

an elevating cab;

a travel hydraulic motor; and processing circuitry configured to detect a position of the elevating cab, fix a traveling mode of the work machine to a first traveling mode between the first traveling mode and a second traveling mode in response to a traveling operation being performed while the detected position of the elevating cab is higher than a predetermined height, the first traveling mode forcibly fixing a motor displacement of the travel hydraulic motor to a low rotation setting, the second traveling mode allowing the motor displacement of the travel hydraulic motor to switch between the low rotation setting and a high rotation setting, and release the traveling mode from being fixed to the first traveling mode in response to the detected position of the elevating cab becoming lower than or equal to the predetermined height.

2. The work machine as claimed in claim 1, wherein the processing circuitry is configured to maintain the traveling mode at the first traveling mode while the detected position of the elevating cab is higher than the predetermined height.

3. The work machine as claimed in claim 1, further comprising:

a hydraulic pump configured to discharge hydraulic oil to the travel hydraulic motor, wherein the processing circuitry is further configured to restrict a discharge quantity of the hydraulic oil discharged by the hydraulic pump to maintain a travel speed of the work machine at a speed lower than a speed in a case of not restricting the discharge quantity.

4. The work machine as claimed in claim 3, further comprising:

an engine configured to drive the hydraulic pump, wherein the processing circuitry is further configured to restrict a rotational speed of the engine to maintain a travel speed of the work machine at a speed lower than a speed in a case of not restricting the rotational speed.

5. The work machine as claimed in claim 3, further comprising:

a plurality of control valves configured to control a flow of the hydraulic oil discharged by the hydraulic pump, wherein the processing circuitry is further configured to restrict an amount of stroke of a spool of each of the plurality of control valves to maintain a travel speed of the work machine at a speed lower than a speed in a case of not restricting the amount of stroke.

6. The work machine as claimed in claim 1, further comprising:

a display, wherein the processing circuitry is configured to display a camera image captured by a back monitoring camera on the display during traveling.

7. The work machine as claimed in claim 1, further comprising:

a display, wherein the processing circuitry is configured to display a composite image of multiple camera images captured by at least two among a left side monitoring camera, a back monitoring camera, and a right side monitoring camera on the display during traveling.

8. The work machine as claimed in claim 1, further comprising:

a display, wherein the processing circuitry is configured to display a message indicating that the traveling mode is fixed to the first traveling mode on the display.

9. The work machine as claimed in claim 1, further comprising:

a display, wherein the processing circuitry is configured to display a mark indicating a status of the traveling mode on the display.

10. The work machine as claimed in claim 1, wherein the processing circuitry is configured to choose the traveling mode between the first traveling mode and the second traveling mode when the detected position of the elevating cab is lower than or equal to the predetermined height.

11. The work machine as claimed in claim 1, wherein the motor displacement of the travel hydraulic motor is larger in the low rotation setting than in the high rotation setting.

12. The work machine as claimed in claim 1, further comprising:

a motor regulator configured to control the motor displacement of the hydraulic motor, wherein the motor regulator is configured to switch the motor displacement of the hydraulic motor between the high rotation setting and the low rotation setting by switching a tilt angle of a swash plate of the hydraulic pump.

* * * * *